US009902079B2

(12) United States Patent
Wang et al.

(10) Patent No.: US 9,902,079 B2
(45) Date of Patent: Feb. 27, 2018

(54) CUTTING APPARATUS FOR TAPE

(71) Applicants: BOE TECHNOLOGY GROUP CO., LTD., Beijing (CN); BOE OPTICAL SCIENCE AND TECHNOLOGY CO., LTD., Suzhou, Jiangsu (CN)

(72) Inventors: Haiyan Wang, Beijing (CN); Chunlei Cao, Beijing (CN); Yuqi Mei, Beijing (CN); Ying Zang, Beijing (CN); Jiawei Zhu, Beijing (CN)

(73) Assignees: BOE TECHNOLOGY GROUP CO., LTD., Beijing (CN); BOE OPTICAL SCIENCE AND TECHNOLOGY CO., LTD., Suzhou, Jiangsu (CN)

( * ) Notice: Subject to any disclaimer, the term of this patent is extended or adjusted under 35 U.S.C. 154(b) by 152 days.

(21) Appl. No.: 14/907,638

(22) PCT Filed: Jun. 18, 2015

(86) PCT No.: PCT/CN2015/081761
§ 371 (c)(1),
(2) Date: Jan. 26, 2016

(87) PCT Pub. No.: WO2016/110059
PCT Pub. Date: Jul. 14, 2016

(65) Prior Publication Data

US 2016/0325451 A1 Nov. 10, 2016

(30) Foreign Application Priority Data

Jan. 9, 2015 (CN) ..... 2015 1 0011603

(51) Int. Cl.
*B26D 1/10* (2006.01)
*B65H 5/06* (2006.01)
(Continued)

(52) U.S. Cl.
CPC ..... *B26D 1/105* (2013.01); *B26D 1/10* (2013.01); *B26D 5/005* (2013.01); *B26D 5/34* (2013.01); *B65H 5/062* (2013.01); *B65H 35/10* (2013.01)

(58) Field of Classification Search
CPC ..... B26D 1/105; B26D 1/10; B26D 5/005; B26D 5/34; B65H 5/062
(Continued)

(56) References Cited

U.S. PATENT DOCUMENTS 4,805,499 A * 2/1989 Chiang ..... B26D 1/105 83/203
5,540,369 A 7/1996 Boreali et al.
(Continued)

FOREIGN PATENT DOCUMENTS

CN 1116418 A 2/1996
CN 1150931 A 6/1997
(Continued)

OTHER PUBLICATIONS

Second Chinese Office Action dated Sep. 26, 2016; Appln. No. 20151001603.6.
(Continued)

*Primary Examiner* — Omar Flores Sanchez
(74) *Attorney, Agent, or Firm* — Ladas & Parry LLP; Loren K. Thompson

(57) ABSTRACT

A cutting apparatus for a tape, on a tape conveying path, sequentially including: a feeding assembly, configured to release the tape at an upstream of the tape conveying path; an roller assembly, including a first roller and a second roller opposite to each other and configured to clamp at least part of the tape therebetween and drive the tape to move on the tape conveying path by rotation of at least one of the first roller and the second roller; and a cutter assembly, config-
(Continued)

ured to cut the tape at a downstream of the tape conveying path, wherein, the cutting apparatus further includes a control assembly, configured to control the cutter assembly to cut the tape according to rotation of at least one of the first roller and the second roller. The cutting apparatus can improve cutting efficiency and accuracy of the tape.

15 Claims, 3 Drawing Sheets

(51) Int. Cl.
*B26D 5/00* (2006.01)
*B26D 5/34* (2006.01)
*B65H 35/10* (2006.01)

(58) Field of Classification Search
USPC ..... 83/401, 436.3
See application file for complete search history.

(56) References Cited

U.S. PATENT DOCUMENTS

| | | | | |
|---|---|---|---|---|
| 5,588,762 | A | 12/1996 | Suzuki | |
| 5,681,036 | A * | 10/1997 | Wakahara | B65H 5/062 271/10.12 |
| 5,862,968 | A | 1/1999 | Traise | |
| 2006/0151119 | A1 | 7/2006 | Klauck et al. | |
| 2007/0193672 | A1 | 8/2007 | Yamamoto | |
| 2009/0190987 | A1 | 7/2009 | Vleurinck et al. | |
| 2010/0330262 | A1 | 12/2010 | Takeuchi et al. | |
| 2011/0211900 | A1 * | 9/2011 | Ueda | B26D 1/095 400/621 |
| 2016/0325451 | A1 * | 11/2016 | Wang | B26D 1/10 |
| 2017/0107073 | A1 * | 4/2017 | Baba | B65H 5/062 |

FOREIGN PATENT DOCUMENTS

| | | | |
|---|---|---|---|
| CN | 1075031 | C | 11/2001 |
| CN | 1849255 | A | 10/2006 |
| CN | 101026088 | A | 8/2007 |
| CN | 101489795 | A | 7/2009 |
| CN | 201267989 | Y | 8/2009 |
| CN | 101934642 | A | 1/2011 |
| CN | 101700839 | B | 9/2011 |
| CN | 202030365 | U | 11/2011 |
| CN | 202156750 | U | 3/2012 |
| CN | 103449235 | A | 12/2013 |
| CN | 103922180 | A | 7/2014 |
| CN | 104444541 | A | 3/2015 |
| JP | 5672860 | U | 11/1954 |
| JP | 5892247 | U | 6/1983 |
| JP | 01321193 | A | 11/1993 |
| JP | 0752089 | A | 2/1995 |
| JP | 3352431 | B2 | 12/2002 |

OTHER PUBLICATIONS

International Search Report and Written Opinion both dated Oct. 19, 2015; PCT/CN2015/081761.

First Chinese Office Action dated Mar. 1, 2016; Appln. No, 201510011603.6.

* cited by examiner

CUTTING APPARATUS FOR TAPE

TECHNICAL FIELD

Embodiments of the present disclosure relate to a cutting apparatus for a tape.

BACKGROUND

Currently, adhesive tapes are very widely used in industrial production; the adhesive tapes can be used in many occasions, and shapes and sizes of the adhesive tapes are mostly different. For example, in a backlight module of a liquid crystal display, shading adhesive tape on an upper prism sheet is irregular, and shading adhesive tapes on different sides are different in length and width and irregular in shape. In this case, adhesive tapes meeting requirements can be directly used, shapes and sizes of such adhesive tapes adapt to specific parts; Alternatively, adhesive tapes with larger sizes can be used; when used, the adhesive tapes are cut to have different shapes and sizes, so as to applicable to different occasions.

However, in the case of directly using the adhesive tapes adaptive to the sizes and shapes of the parts, there is a need for a large variety of adhesive tapes, and the large variety of adhesive tapes need to be purchased, which causes a relatively high cost; if the adhesive tapes with large sizes are cut to obtain adhesive tapes in required specification, then in a cutting process, feeding and cutting are required, which involves a large amount of manual operation, and it is difficult to realize automatic cutting of the adhesive tapes, production efficiency is relatively low, and excessive manual operation causes low accuracy of sizes of the adhesive tapes after cutting.

SUMMARY

Embodiments of the present disclosure provide a cutting apparatus for a tape, sequentially comprising, on a tape conveying path: a feeding assembly, configured to release the tape at an upstream of the tape conveying path; an roller assembly, including a first roller and a second roller opposite to each other and configured to clamp at least part of the tape therebetween and drive the tape to move on the tape conveying path by rotation of at least one of the first roller and the second roller; and a cutter assembly, configured to cut the tape at a downstream of the tape conveying path, wherein, the cutting apparatus further comprises a control assembly, configured to control the cutter assembly to cut the tape according to the rotation of at least one of the first roller and the second roller

BRIEF DESCRIPTION OF THE DRAWINGS

In order to clearly illustrate technical solution of the embodiments of the present disclosure, the drawings of the embodiments will be briefly described in the following; it is obvious that the drawings described hereinafter are only some embodiments of the present disclosure, and a person of ordinary skill in the art can obtain other drawings, without any inventive work, according to these drawings.

DETAILED DESCRIPTION

Figure 1:
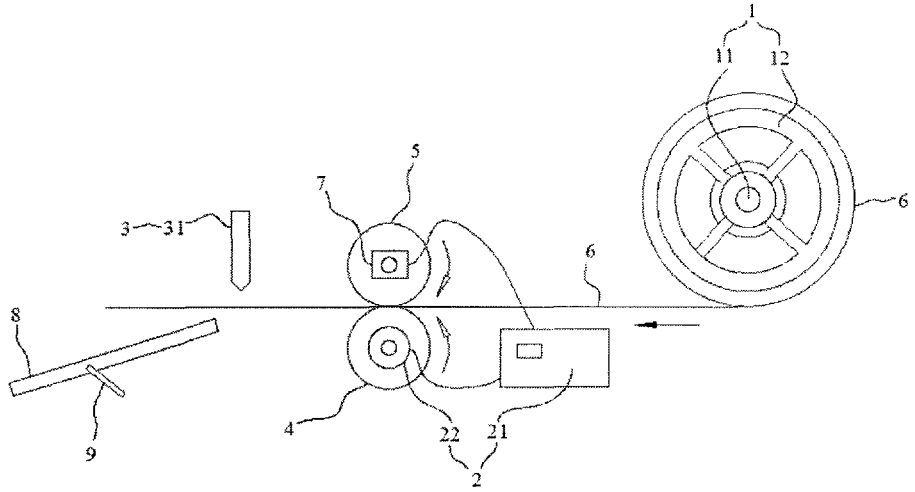
FIG. 1 is a schematic diagram of a first implementation mode of an adhesive tape cutting apparatus provided by a first embodiment of the present disclosure.

The technical solutions of the embodiments will be described in a clearly and fully understandable way in connection with the drawings related to the embodiments of the present disclosure. It is obvious that the described embodiments are just a part but not all of the embodiments of the disclosure. Based on the described embodiments herein, those skilled in the art can obtain other embodiment (s), without any inventive work, which should be within the scope of the disclosure.

Unless otherwise defined, technical terms or scientific terms used herein have ordinary meanings understood by a person of ordinary skill in the art of the present disclosure. "First", "second" and similar words in the description and claims of the present disclosure do not mean any sequence, quantity or importance, but only intend to differentiate different composite parts. Similarly, "one" or "a/an" and other similar words mean at least one instead of quantitative limitation. "Connected" or "connecting" or similar words are not limited to physical or mechanical connection, and may comprise electrical connection, either direct or indirect connection. "Upper", "lower", "left", and "right" only show relative positional relationships, which change correspondingly after absolute positions of the described objects have changed. Thicknesses and shapes of respective film layers in the drawings do not reflect a real proportion and only intend to explain the content of the present disclosure.

An embodiment of the present disclosure provides an adhesive tape cutting apparatus, capable of improving cutting efficiency and accuracy of an adhesive tape.

With reference to FIG. 1, FIG. 1 shows an adhesive tape cutting apparatus provided by a first embodiment of the present disclosure. An adhesive tape 6 adopted in the embodiment is a single-sided sticky adhesive tape. For example, a first side of the adhesive tape 6 is an adhesive surface and is accompanied with release paper (not shown). In another embodiment, the adhesive tape 6 is, for example, a double-sided sticky adhesive tape, and each sticky surface is accompanied with a release paper.

On an adhesive tape conveying path, the adhesive tape cutting apparatus sequentially comprises a feeding assembly 1, a control assembly 2, an roller assembly (comprising a first roller 4 and a second roller 5 oppositely arranged), and a cutter assembly 3. In a feeding direction of the adhesive tape 6, the feeding assembly 1 is positioned on one side of the first roller 4 and the second roller 5, while the cutter assembly 3 is positioned on an opposite side of the first roller 4 and the second roller 5. With regard to the to-be-cut adhesive tape 6, one end thereof is arranged on the feeding assembly 1 while the other end thereof is pressed between the first roller 4 and the second roller 5. The release paper is in contact with the second roller 5. The control assembly 2 can control the first roller 4 and/or the second roller 5 to rotate by preset number of turns and angles. The feeding assembly 1 is configured to release the adhesive tape 6 at upstream of the tape conveying path. The roller assembly includes the first roller 4 and the second roller 5 which are opposite to each other. The first roller 4 and the second roller 5 configured to clamp at least part of the adhesive tape 6 therebetween and drive the adhesive tape 6 to move on the tape conveying path by rotation of at least one of the first roller 4 and the second roller 5. The cutter assembly 3 is configured to cut the adhesive tape 6 at downstream of the tape conveying path. In a case that the first roller 4 and/or the second roller 5 inwardly rotate(s) (as shown by a hollow arrow in FIG. 1) preset number of turns and angles, the adhesive tape 6 between the first roller 4 and the second roller 5 moves in a direction as shown by a solid arrow in FIG. 1. In FIG. 1, the solid arrow indicates a feeding direction of the adhesive tape 6, and the hollow arrow indicates a rotational direction of the first roller 4 and the second roller when feeding.

During operation of the adhesive tape cutting apparatus provided by the embodiment of the present disclosure, one end of the to-be-cut adhesive tape 6 is arranged on the feeding assembly 1, while the other end is pressed between the first roller 4 and the second roller 5; the control assembly 2 controls the first roller 4 and/or the second roller 5 to rotate by preset number of turns and angles; In this case, under the action of static friction forces applied by the first roller 4 and the second roller 5 (namely the first roller 4 and the second roller do not slide with respect to the adhesive tape), the moving distance of the to-be-cut adhesive tape 6 corresponds to the preset number of turns and angles. When the to-be-cut adhesive tape 6 exceeds the cutter assembly by a distance equal to a required length of the adhesive tape, the control assembly 2 controls the cutter assembly 3 to cut the adhesive tape 6 and an adhesive tape in required specification is finally obtained. During the operation of the adhesive tape cutting apparatus, an operator only needs to start the control assembly 2 after the to-be-cut adhesive tape 6 is loaded, and the feeding and cutting process can be automatically implemented, thus avoiding manual operation in the feeding and cutting process and improving feeding and cutting efficiency; in addition, less manual operation reduces errors caused by the manual operation. Thereby, the cutting efficiency and accuracy of the adhesive tape are improved.

The preset number of turns and angles rotated by the first roller 4 and the second roller 5 can be determined according to a required length of the adhesive tape; for example, a radial section of the first roller 4 is round, and a perimeter thereof is set as L1, in a case that the control assembly 2 controls the first roller 4 to rotate, the preset number of turns rotated by the first roller 4=the required length of the adhesive tape/L1, and the preset angle rotated by the first roller 4=2π×the required length of the adhesive tape/L1; In a case that the control assembly 2 controls the second roller 5 to rotate, the preset number of turns and angle are determined in a similar way, which is not repeated herein.

Figure 2:
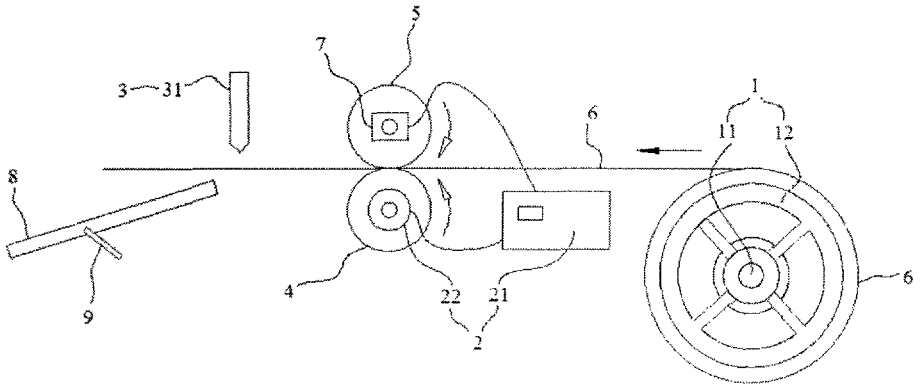
FIG. 2 is a schematic diagram of a second implementation mode of an adhesive tape cutting apparatus provided by a second embodiment of the present disclosure.

FIG. 2 is an adhesive tape cutting apparatus provided by a second embodiment of the present disclosure. As shown in FIG. 2, the adhesive tape cutting apparatus can have a configuration basically same as the adhesive tape cutting apparatus provided by the first embodiment, except that the release paper adhered to the adhesive tape 6 is in contact with the first roller 4. Therefore, repeated description of same parts is omitted herein, and the same terms and same reference signs denote same parts. In FIG. 2, a solid arrow indicates a feeding direction of the adhesive tape 6, and a hollow arrow indicates a rotational direction of the first roller 4 and the second roller 5 when feeding.

Figure 3:
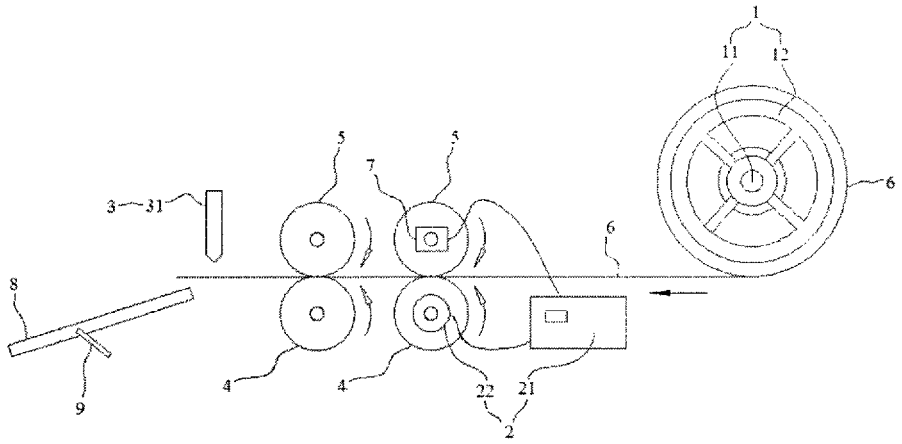
FIG. 3 is a schematic diagram of a third implementation mode of an adhesive tape cutting apparatus provided by a third embodiment of the present disclosure.

In the adhesive tape cutting apparatus, a plurality of roller assemblies can be arranged, and each roller assembly includes a first roller 4 and a second roller 5 corresponding to each other. The adhesive tape 6 is pressed among the plurality of groups of first rollers 4 and second rollers 5. Therefore, the adhesive tape can be fed and supported by using the plurality of groups of rollers, thus achieving greater stability during feeding of the adhesive tape of larger size. FIG. 3 is an adhesive tape cutting apparatus provided by a third embodiment of the present disclosure. As shown in FIG. 3, the adhesive tape cutting apparatus has a configuration basically same as that of the adhesive tape cutting apparatus provided by the first embodiment except that the plurality of groups of first rollers 4 and second rollers 5 are arranged. Hence, repeated description of same parts is omitted herein, and same terms and same reference signs denote same parts. As shown in FIG. 3, in the adhesive tape cutting apparatus, two roller assemblies are arranged, and each roller assembly includes the first roller 4 and the second roller 5 opposite to each other. In FIG. 3, a solid arrow indicates a feeding direction of the adhesive tape 6, and a hollow arrow indicates a rotational direction of the first roller 4 and the second roller 5 when feeding.

Actual rotated number of turns and angles of the first roller 4 and the second roller 5 can be different from the preset number of turns and angles due to possible faults when used, thus reducing cutting accuracy. In order to improve the accuracy, the adhesive tape cutting apparatus can further comprise a detecting device 7, which is arranged onto the first roller 4 and/or the second roller 5 and used for detecting the actual rotated number of turns and angles of the roller (the first roller 4 and/or the second roller 5) provided with the detecting device 7, and feeding back an actual number of turns and actual angle signal to the control assembly 2. The control assembly 2 can compare the actual number of turns and actual angle signal with the preset number of turns and angles. In a case that an error presents, the control assembly 2 controls the first roller 4 and/or the second roller 5 to stop rotating, and controls the cutter assembly to stop cutting, so as to facilitate checking and repairing; In a case that no error presents, the operation is continued.

In order to facilitate discharging, the adhesive tape cutting apparatus can further comprise a discharging plate 8. In a feeding direction of the adhesive tape 6, the first roller 4 and the second roller 5 are positioned on an upstream side of the cutter assembly 3, and the discharging plate 8 is positioned on a downstream side of the cutter assembly 3. The discharging plate 8 is provided with a sensing device 9. In a case that a portion cut off from the adhesive tape 6 falls on the discharging plate 8, the sensing device 9 sends a sensing signal to the control assembly 2. The control assembly 2 stops actions of the first roller 4, the second roller 5 and the cutter assembly 3 after receiving the sensing signal. In a case that the portion cut off from the adhesive tape 6 moves out of the discharging plate 8, the control assembly 2 controls the first roller 4, the second roller 5 and the cutter assembly 3 to restart acting.

Figure 4:
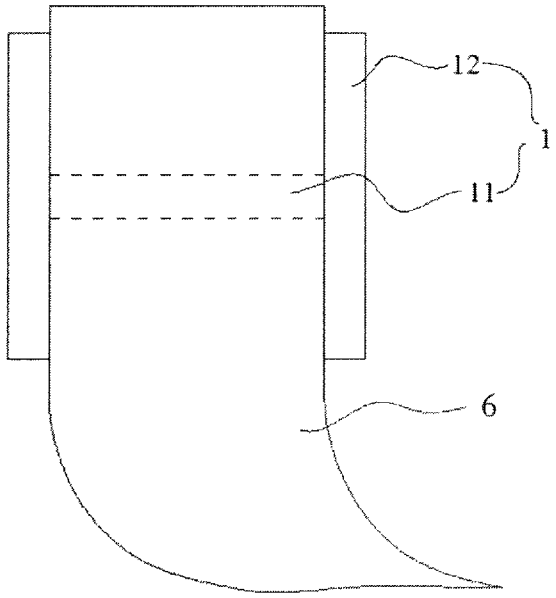
FIG. 4 is an assembly diagram of an adhesive tape and a feeding assembly of an adhesive tape cutting apparatus provided by an embodiment of the present disclosure.
Figure 5:
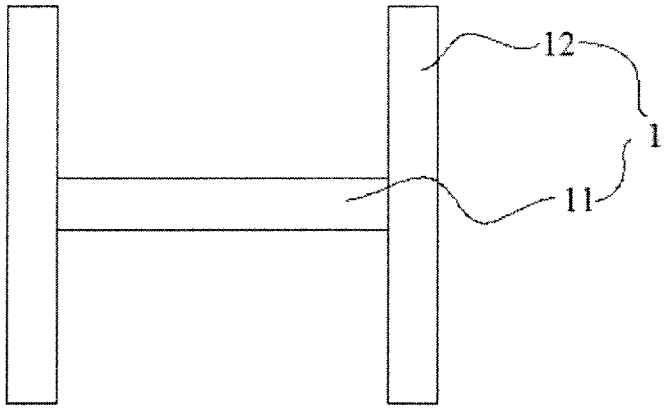
FIG. 5 is a schematic diagram of a feeding assembly of an adhesive tape cutting apparatus provided by an embodiment of the present disclosure.

FIG. 4 is an assembly diagram of an adhesive tape and a feeding assembly of the adhesive tape cutting apparatus provided by an embodiment of the present disclosure; and FIG. 5 is a schematic diagram of a feeding assembly of an adhesive tape cutting apparatus provided by an embodiment of the present disclosure.

With inference with FIG. 4 and FIG. 5, the feeding assembly 1 includes a reel 11 and baffles 12 arranged at two ends of the reel 11. The baffles 12 can move along an axial direction of the reel 11, and are detachably connected with the reel 11, the to-be-cut adhesive tape 6 is wound on the reel 11 and clamped by the baffles 12 from two sides; when the to-be-cut adhesive tape has different widths need, it is only needed to wind the adhesive tape on the reel 11 or to directly sleeve the reel 11 with an adhesive tape coil, and then the adhesive tape is clamped by moving the baffles 12. The baffles 12 and the reel 11 are connected by parts such as bolts (not shown). Therefore, adhesive tapes with different widths can be mounted onto the feeding assembly 1, thus enlarging an applicable range of the adhesive tape cutting apparatus.

Figure 6:
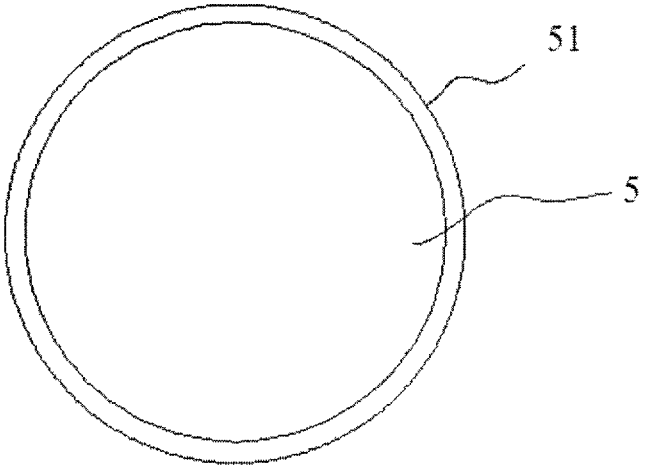
FIG. 6 is a schematic diagram of a second roller of an adhesive tape cutting apparatus provided by an embodiment of the present disclosure.

FIG. 6 is a schematic diagram of a second roller of an adhesive tape cutting apparatus provided by an embodiment of the present disclosure. With reference to FIG. 1 and FIG. 6, when the adhesive tape 6 is a single-sided sticky adhesive tape without release paper, in order to prevent a sticky surface of the adhesive tape from being adhered to the first roller 4 or the second roller 5, an anti-adhesive layer 51 made of an anti-adhesive material is coated on a surface of the first roller 4 or the second roller 5, thus avoiding the sticky surface of the adhesive tape 6 from being adhered to the first roller 4 or the second roller 5 when the single-sided sticky adhesive tape without release paper is used, and ensuring smooth feeding. Hence, an applicable range of the adhesive tape cutting apparatus is further enlarged.

The cutter assembly 3 includes a cutter 31 and a driving device (not shown). The driving device can drive the cutter 31 to move between an initial position and a cutting position. The control assembly 2 controls the movements of the cutter 31 by controlling the driving device. When the cutter 31 is positioned at the cutting position, the cutter 31 above the adhesive tape 6 cuts off the adhesive tape 6 below. Thus, a special control element for the cutter assembly 3 is omitted, and the structure is simplified. On the other hand, because the control assembly 2 can control the motions of the first roller 4, the second roller 5 and the cutter assembly 3, thus facilitating coordinated motions of the first roller 4, the second roller 5 and the cutter assembly 3.

In order to conveniently clamp the adhesive tape 6 by the first roller 4 and the second roller 5, axes of the first roller 4 and the second roller 5 can be arranged on a same vertical plane, and the second roller 5 is positioned right above the first roller 4; on the other hand, the control assembly 2 can control rotations of the first roller 4 and the second roller 5, or the control assembly 2 can control rotation of one of the first roller 4 and the second roller 5. In order to simplify the structure and avoid excessive connection structures, the control assembly 2 can control one of the rollers to rotate. Due to gravity, the adhesive tape 6 is in close contact with the first roller 4 below the adhesive tape 6; hence, in order to conveniently drive the adhesive tape 6, the control device 2 can control the first roller 4 to rotate. When the adhesive tape 6 moves, the second roller 5 is driven to rotate by the adhesive tape 6 accordingly. In addition, in order to avoid disadvantageously mounting excessive assembles on the same roller, the detecting device 7 can be arranged on the second roller 5, thus facilitating the mounting of the detecting device 7.

The control device 2 includes, for example, a single chip microcomputer 21 and a motor 22. The motor 22 is in transmission connection with the first roller 4. The single chip microcomputer 21 enables the first roller 4 to rotate by a preset number of turns and angle by controlling rotation of the motor 22; small size and high integration of the single chip microcomputer are favorable for reducing the size of the control device 2, and meanwhile, a command system of the single chip microcomputer is rich and may conveniently control different assemblies through programming.

The detecting device 7 can adopt a photoelectric rotary encoder which is connected with the single chip microcomputer 21.

The sensing device 9 is, for example, a photoelectric sensor which is connected with the single chip microcomputer 21.

In order to conveniently move the portion cut off from the adhesive tape 6 on the discharging plate 8 out of the discharging plate 8, the discharging plate is obliquely arranged, and the portion cut off from the adhesive tape 6 moves out of the discharging plate 8 under a gravity action along a surface of the discharging plate 8.

According to above description, the embodiments of the present disclosure may at least provide structures as follows:

(1) A cutting apparatus for a tape, sequentially comprises, on a tape conveying path:

a feeding assembly, configured to release the tape at an upstream of the tape conveying path;

an roller assembly, including a first roller and a second roller opposite to each other and configured to clamp at least part of the tape therebetween and drive the tape to move on the tape conveying path by rotation of at least one of the first roller and the second roller; and a cutter assembly, configured to cut the tape at a downstream of the tape conveying path, wherein, the cutting apparatus further comprises a control assembly, configured to control the cutter assembly to cut the tape according to the rotation of at least one of the first roller and the second roller.

(2) The cutting apparatus according to (1), wherein, the cutter assembly is controlled to cut the tape in response to that the at least one of the first roller and the second roller rotates by a preset angle.

(3) The cutting apparatus according to (1) or (2), further comprising a detecting device, which is arranged on the first roller and/or the second roller and configured for detecting an actual rotated angle of the roller provided with the detecting device, and feeding back an actual angle signal to the control assembly, wherein the control assembly judges whether an error presents between the actual angle and a preset angle according to the actual angle signal, and stops the rotation of the first roller and/or the second roller in response to presence of error.

(4) The cutting apparatus according to any one of (1) to (3), further comprising a discharging plate, positioned on a downstream side of the cutter assembly on the tape conveying path, the discharging plate being provided with a sensing device, the sensing device being configured to send a sending signal to the control assembly according to whether a cutting portion of the tape falls on the discharging plate, the control assembly being configured to control the first roller, the second roller and the cutter assembly to stop or re-start operation based on the sensing signal.

(5) The cutting apparatus according to any one of (1) to (4), wherein, the feeding device includes a reel and baffles arranged on two ends of the reel, the baffles are movable along an axial direction of the reel and are detachably connected with the reel.

(6) The cutting apparatus according to any one of (1) to (5), wherein, a plurality of roller assemblies are arranged between the feeding assembly and the cutting assembly on the tape conveying path.

(7) The cutting apparatus according to any one of (1) to (6), wherein, in a vertical direction perpendicular to a horizontal direction, the second roller is positioned above the first roller, the control device is configured to control the first roller to rotate, and the detecting device is arranged on the second roller.

(8) The cutting apparatus according to any one of (1) to (7), wherein, an anti-adhesive layer is coated on the first roller and/or the second roller.

(9) The cutting apparatus according to any one of (1) to (8), wherein, the cutter assembly includes a cutter and a driving device, the driving device is configured to drive the cutter to move between an initial position and a cutting position, and the control assembly is configured to control the cutter to move by controlling the driving device.

(10) The cutting apparatus according to (7), wherein, the control assembly includes a single chip microcomputer and a motor, the motor is in transmission connection with the first roller, and the single chip microcomputer is configured to control the first roller to rotate by controlling the motor.

(11) The cutting apparatus according to (3), wherein, the detecting device is a photoelectric rotary encoder.

(12) The cutting apparatus according to (4), wherein, the sensing device is a photoelectric sensor.

(13) The cutting apparatus according to (4), wherein, the discharging plate is obliquely arranged to cause a cutting portion of the tape to move out of the discharging plate along a surface of the discharging plate.

Above embodiments only intend to describe instead of limiting the present disclosure, a person of ordinary skill in related arts can make various alternations and transformations without departing from the spirit and scope of the present disclosure, and therefore, all equivalent technical solutions belong to the scope of the present disclosure, and a patent protection scope of the present disclosure is defined by claims.

The application claims priority of Chinese Patent Application No. 201510011603.6 filed on Jan. 9, 2015, the disclosure of which is incorporated herein by reference in its entirety as part of the present application.

The invention claimed is:

1. A cutting apparatus for a tape, sequentially comprising, on a tape conveying path:

a feeding assembly, configured to release the tape at an upstream of the tape conveying path;

an roller assembly, including a first roller and a second roller opposite to each other and configured to clamp at least part of the tape therebetween and drive the tape to move on the tape conveying path by rotation of at least one of the first roller and the second roller; and a cutter assembly, configured to cut the tape at a downstream of the tape conveying path, wherein, the cutting apparatus further comprises a control assembly, configured to control the cutter assembly to cut the tape according to the rotation of at least one of the first roller and the second roller, wherein, the cutter assembly is controlled to cut the tape in response to that the at least one of the first roller and the second roller rotates by a preset angle.

2. The cutting apparatus according to claim 1, further comprising a detecting device, which is arranged on the first roller and/or the second roller and configured for detecting an actual rotated angle of the roller provided with the detecting device, and feeding back an actual angle signal to the control assembly, wherein the control assembly judges whether an error presents between the actual angle and a preset angle according to the actual angle signal, and stops the rotation of the first roller and/or the second roller in response to presence of error.

3. The cutting apparatus according to claim 1, further comprising a discharging plate, positioned on a downstream side of the cutter assembly on the tape conveying path, the discharging plate being provided with a sensing device, the sensing device being configured to send a sending signal to the control assembly according to whether a cutting portion of the tape falls on the discharging plate, the control assembly being configured to control the first roller, the second roller and the cutter assembly to stop or re-start operation based on the sensing signal.

4. The cutting apparatus according to claim 1, wherein, the feeding device includes a reel and baffles arranged on two ends of the reel, the baffles are movable along an axial direction of the reel and are detachably connected with the reel.

5. The cutting apparatus according to claim 1, wherein, a plurality of roller assemblies are arranged between the feeding assembly and the cutting assembly on the tape conveying path.

6. The cutting apparatus according to claim 1, wherein, in a vertical direction perpendicular to a horizontal direction, the second roller is positioned above the first roller, the control device is configured to control the first roller to rotate, and the detecting device is arranged on the second roller.

7. The cutting apparatus according to claim 1, wherein, an anti-adhesive layer is coated on the first roller and/or the second roller.

8. The cutting apparatus according to claim 1, wherein, the cutter assembly includes a cutter and a driving device, the driving device is configured to drive the cutter to move between an initial position and a cutting position, and the control assembly is configured to control the cutter to move by controlling the driving device.

9. The cutting apparatus according to claim 6, wherein, the control assembly includes a single chip microcomputer and a motor, the motor is in transmission connection with the first roller, and the single chip microcomputer is configured to control the first roller to rotate by controlling the motor.

10. The cutting apparatus according to claim 2, wherein, the detecting device is a photoelectric rotary encoder.

11. The cutting apparatus according to claim 3, wherein, the sensing device is a photoelectric sensor.

12. The cutting apparatus according to claim 3, wherein, the discharging plate is obliquely arranged to cause a cutting portion of the tape to move out of the discharging plate along a surface of the discharging plate.

13. The cutting apparatus according to claim 2, further comprising a discharging plate, positioned on a downstream side of the cutter assembly on the tape conveying path, the discharging plate being provided with a sensing device, the sensing device being configured to send a sending signal to the control assembly according to whether a cutting portion of the tape falls on the discharging plate, the control assembly being configured to control the first roller, the second roller and the cutter assembly to stop or re-start operation based on the sensing signal.

14. The cutting apparatus according to claim 2, wherein, the feeding device includes a reel and baffles arranged on two ends of the reel, the baffles are movable along an axial direction of the reel and are detachably connected with the reel.

15. The cutting apparatus according to claim 3, wherein, the feeding device includes a reel and baffles arranged on two ends of the reel, the baffles are movable along an axial direction of the reel and are detachably connected with the reel.

* * * * *